United States Patent [19]

Chow

[11] Patent Number: 4,471,350

[45] Date of Patent: Sep. 11, 1984

[54] DISPLAY DEVICE USING A DISCHARGE LAMP

[76] Inventor: Shing C. Chow, 12A Suffolk Rd., Kowloon, Hong Kong

[21] Appl. No.: 299,613

[22] Filed: Sep. 4, 1981

[30] Foreign Application Priority Data

| | | | |
|---|---|---|---|
| Sep. 12, 1980 | [JP] | Japan | 55-127842 |
| Oct. 24, 1980 | [JP] | Japan | 55-152845[U] |
| Jul. 4, 1981 | [JP] | Japan | 56-104754 |

[51] Int. Cl.[3] ..... G09F 9/00

[52] U.S. Cl. ..... 340/759; 313/515; 313/519; 315/254; 315/276; 340/779; 340/811; 340/815.18; 340/815.2

[58] Field of Search ..... 340/815.15, 815.18, 340/815.2, 758, 759, 760, 811, 771, 772, 774, 779; 315/254, 276; 313/201, 202, 514, 515, 519

[56] References Cited

U.S. PATENT DOCUMENTS

| | | | |
|---|---|---|---|
| 2,004,577 | 6/1935 | Lebedenico et al. | 340/774 X |
| 2,291,467 | 7/1942 | Goldberg | 313/201 X |
| 3,124,712 | 3/1964 | Alexander | 313/202 |
| 3,157,823 | 11/1964 | Clapp | 340/771 X |
| 3,947,722 | 3/1976 | Strom et al. | 340/779 X |

*Primary Examiner*—David L. Trafton

*Attorney, Agent, or Firm*—Dennison, Meserole, Pollack & Scheiner

[57] ABSTRACT

Display device using a discharge lamp for displaying a series of message formed of characters, numerals or symbols by combining various kinds of discharge lamps which are different in shape and size. Inert gas is charged in a glass tube of the discharge lamp, one of the electrodes is provided within the glass tube and the other is provided outside of the glass tube. Pulse signal or AC signal generator is provided and serves to supply such signals to both electrodes. The various kinds of discharge lamps are combined and arranged on the surface plate of a display unit. A plurality of display units are combined and magnetically connected to a display panel. A plurality of electrically conductive segments mounted on the back portion of the display unit are electrically connected to a plurality of feeder plates. Additionally, there are provided in the display unit a boosting transformer for boosting pulse signals or AC signals to be supplied, a transistor, and power supply. Furthermore, the present device includes a control means for on-off controlling the firing of the discharge lamp alternately at every given period of time and/or a switching means for continuously firing the discharge lamp or on-off controlling the firing of the discharge lamp by continuously or intermittently supplying pulse signals or AC signals through the control means to the transistor.

9 Claims, 46 Drawing Figures

FIG. 8 ( d )
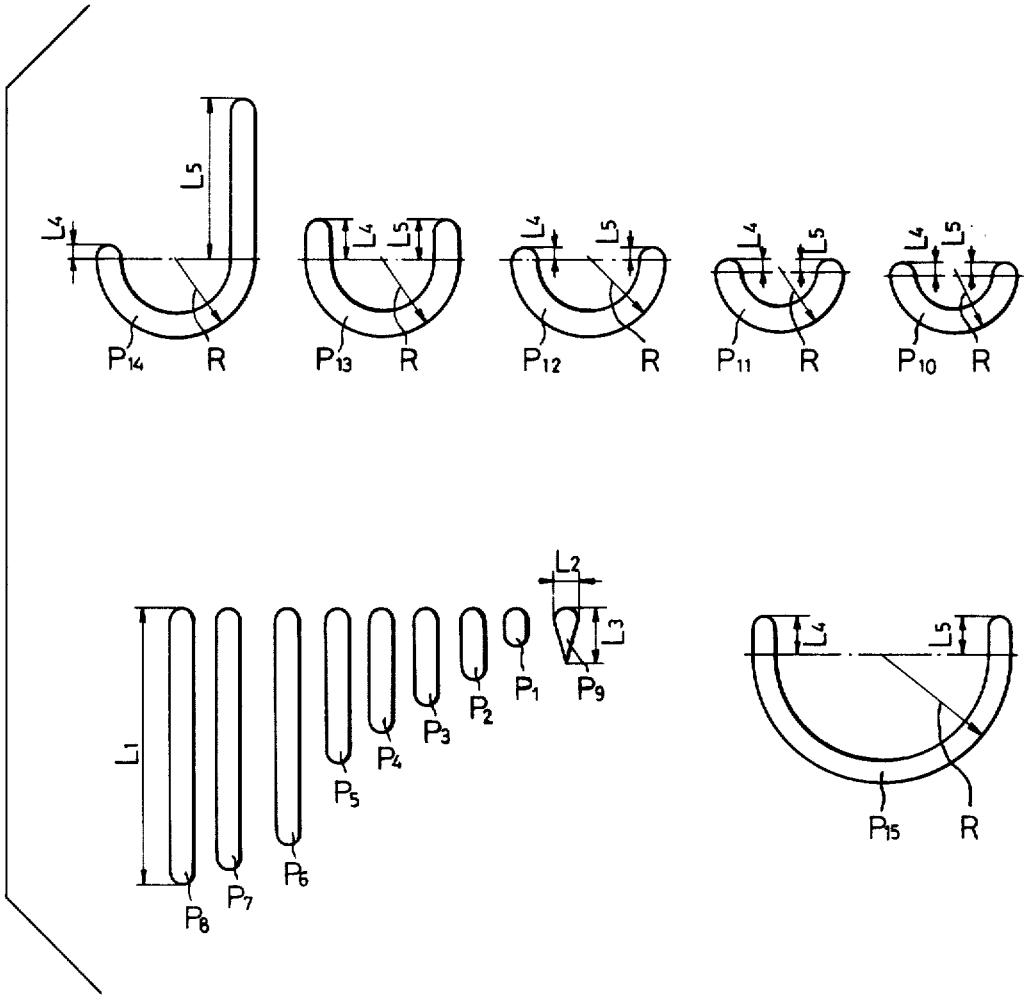

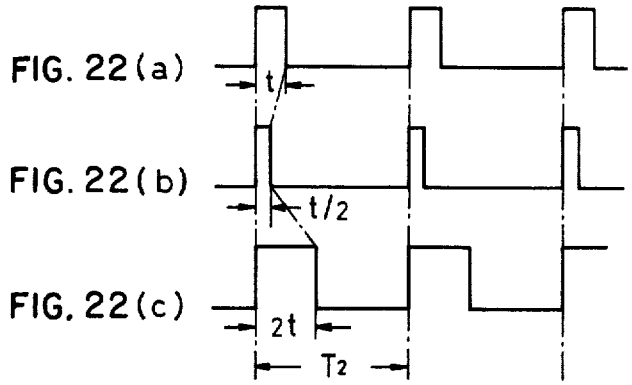
FIG. 22(a)
t
FIG. 22(b)
t/2
FIG. 22(c)
2t
T2
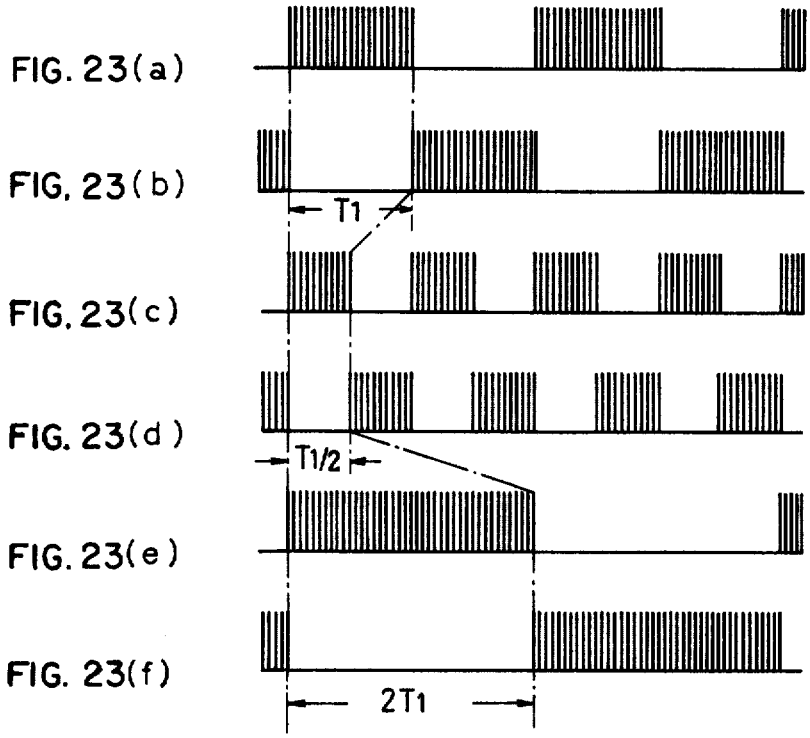
FIG. 23(a)
FIG. 23(b)
T1
FIG. 23(c)
FIG. 23(d)
T1/2
FIG. 23(e)
FIG. 23(f)
2T1

FIG. 24
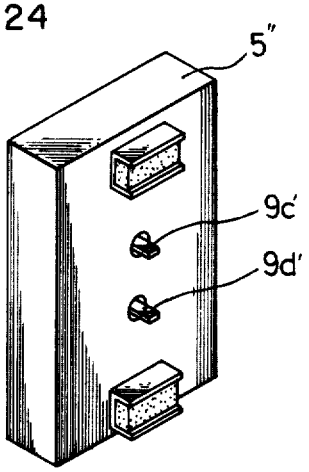
FIG. 25 (a)
FIG. 25 (b)
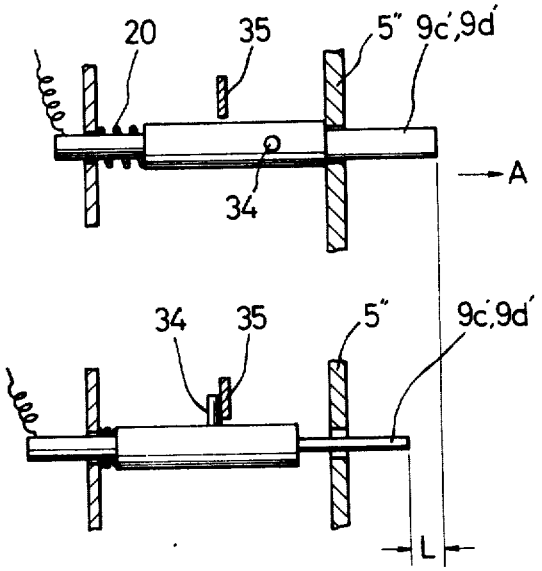

DISPLAY DEVICE USING A DISCHARGE LAMP

BACKGROUND OF THE INVENTION

The present invention relates to a display device using a discharge lamp, and particularly to a display device which is compact in size and light in weight and suitable for displaying characters, numerals, symbols, etc.

Conventionally, since the discharge voltage and current for discharge lamps utilizing a glow-discharge tube such as neon tube are relatively low, such discharge lamps have been widely used for pilot lamps or beacon lamps.

As is well known in the art, since this type of glow discharge lamps is constructed to generate glow-discharge between the electrodes provided within a glass tube, the area of electroluminescence is limited to the vicinity of the electrodes.

To employ this type of discharge lamps for a display device and permit discharge with electro-luminescence substantially throughout the length of the glass tube, the electrodes provided within the glass tube must be made large or formed to a special shape, whereupon the discharge starting voltages becomes remarkably high or the discharge lamp becomes remarkably large.

In addition to the above type of discharge lamps, there is a well known type of discharge lamps, where both of two electrodes are provided outside of the glass tube and the gas charged within the glass tube is indirectly driven to display various information.

To drive the gas charged within a glass tube indirectly and carry out effective electro-luminescence, it is necessary to cover the area proximate to the electrodes with a material having high dielectric constant and also necessary to supply AC power having high frequency and voltage.

The display device utilizing discharge lamps such as neon discharge lamp develops a relatively high luminance upon discharging and various colored lights by suitably selecting gases to be charged in the discharge tube of fluorescent paints to be applied to the inner wall of the discharge tube, and thus it has been widely employed in a display field.

As is well known in the art, since the display device utilizing discharge lamps require a AC power supply having high voltage of several thousand volts or more and high frequency of several ten kilo hertz or more, for example, it is essential to provide a power supplying system including a starting circuit, and further to provide means for preventing an electric shock due to high voltage. As a result, this type of display device using a discharge lamp is usually disposed outdoors and utilized for purposes of advertisement.

OBJECTS AND SUMMARY OF THE INVENTION

Accordingly, it is the primary object of the present invention to provide a unique display device for displaying any characters, numerals or symbols which is compact and lightweight, wherein one of the two electrodes is provided within and along the length of a discharge tube and the other is provided on the outer wall of the discharge tube and opposite to the former electrode, and substantially entire area of the glass tube can be uniformly flashed by a AC power supply having relatively low voltage and frequency.

It is another object of the present invention to provide a display device utilizing a discharge lamp which develops various colored lights by suitably selecting gases to be charged in a discharge tube or fluorescent materials to be applied to the inner wall of a discharge tube and may be formed in any desired shape such as a straight tube or curved tube.

It is a further object of the present invention to provide a display device which improves displaying effect of such a display device installed i- or out of vehicles for purposes of advertisement.

It is a still further object of the present invention to provide a display device for displaying various information by suitably combining and disposing a plurality of display units on a display panel and for utilizing discharge lamps which are mounted on a display unit to be flashed in response to the control signals supplied intermittently. Such two or more display units suitably arranged are adapted to carry out alternate flashing display or sequential flashing display.

The display device in accordance with the present invention includes a discharge lamp mounted on a surface plate of a display unit which is detachably mounted on the display panel; a plurality of feeder plates arranged on the display panel and electrically conductive segements arranged on the display unit which are electrically connected to the feeder plates through which DC power and control signals are supplied from a flashing power supply means, for example, power supply means and control signal generating means, to the display unit; and a boosting transformer enclosed in the display unit for boosting DC intermittent wave form signals according to the control signals and supplying such signals to the discharge lamp, wherein the control signals controlled intermettently at every given period of time are supplied through the feeder plates and electrically conductive segments to the boosting transformer. The display device is capable of selectively supplying control signals which have a constant phase relationship and are intermittently turned on and off at every given period of time.

These and other objects and many of the attendant advantages of this invention will be readily appeciated as the same becomes better understood by reference to the following detailed description when considered in connection with the accompanying drawings.

BRIEF DESCRIPTION OF THE DRAWINGS

FIG. 8(*d*) is a plan view of various shaped of discharge lamps using display patterns illustrated in FIGS. 8(*a*), 8(*b*) and 8(*c*);

FIGS. 22(*a*) to (*c*) and 23(*a*) to (*f*) show wave forms of the output control signals;

FIG. 24 is a perspective view of an alternative embodiment of the display unit shown in FIG. 13;

FIGS. 25(*a*) and (*b*) are a partially sectional view of the electrically conductive segments 9*c*' and 9*d*' of the display unit 5" shown in FIG. 24.

DETAILED DESCRIPTION OF THE PREFERRED EMBODIMENTS

In the following description, a discharge lamp applied to the display unit is relatively small in size, for example, the diameter of the discharge tube P ranges from about 2 mm to 10 mm and the length ranges from about 10 mm to 100 mm, but any discharge lamps which are larger in size may be employed in response to the uses of the display system.

Figure 1:
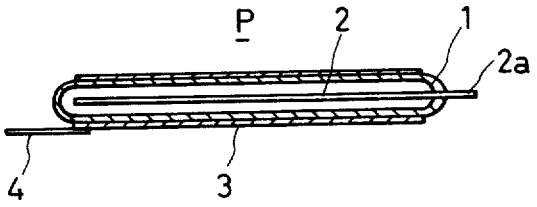
FIGS. 1–5 are cross sectional views of the discharge lamps P applied to the display device according to the present invention.

FIG. 1 shows a basic construction of the discharge lamp P to be applied to the display system in the preferred embodiment. Referring to FIG. 1, there is shown a glass tube 1 which is made of soft glass such as transparent soda glass, or hard glass such as borosilicate glass, and formed in an arbitrary shape, for example, straight or curved shape as shown in the drawings. Inert gas such as neon, krypton or xenon gas is charged in the glass tube 1 under pressure from about several mmHg to several hundred mmHg. A linear electrode 2 is provided within the glass tube 1 and along the length thereof as shown in the drawing. In the case that the glass tube 1 is made of soft glass, Dumet wire may be used for the electrode 2; in the case that the glass tube 1 is made of hard glass, a tungsten wire may be used for the electrode 2. Additionally, the electrode 2 may be provided at its appropriate part with a known getter material such as titanium, tantalum or zirconium which is highly effective to absorb a harmful discharged substance such as harmful gas or impurity to further lengthen the life time of the discharge lamp. An electrode 3 is provided outside of the glass tube 1 and along the length thereof, and in opposing relationship with the electrode 2. The electrode 3 is formed by spraying an aqueous solution of tin halide under the atomized condition onto the surface of the glass tube 1 heated at 500° to 700° C. to deposit an transparent electrically conductive film of tin oxide on the surface. An electrically conductive wire 4 serves to apply voltage to the electrode 3.

Figure 2:
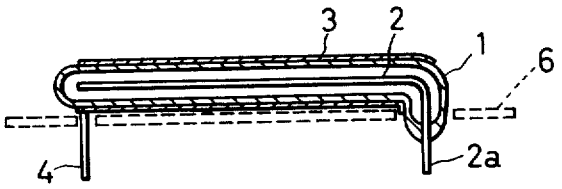
Figure 3:
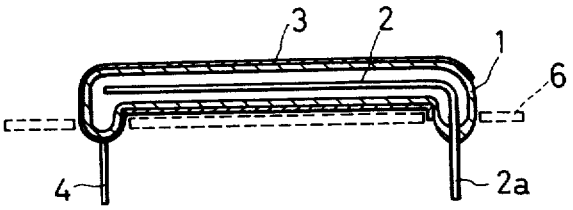

FIGS. 2 and 3 show similar discharge lamps P except that in FIG. 2 one end portion of the glass tube 1 is bended downwardly and in FIG. 3 both end portions are bended downwardly, and also end portion 2*a* of the electrode 2 and the electrically conductive wires 4 extend downwardly. According to the present embodiment, end portion 2*a* of the electrode 2 and the electrically conductive wire 4 can be embedded into the surface plate 6 of the display unit 5 (refer to FIGS. 6 and 7), so that the mounting of the discharge lamp P to the surface plate 6 and the voltage supplying to the discharge lamp P is more readily carried out. Further, since only electrode 3 on the ground is exposed to the surface plate 6, there is no possibility of causing an electric shock even if a human body directly contacts with the electrode 3.

Figure 4:
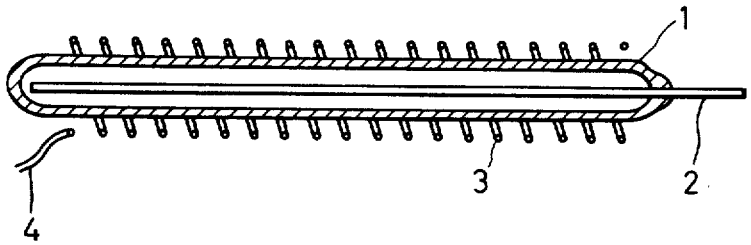

FIG. 4 shows a discharge lamp employing an electrically conductive wire coiled around the glass tube 1 for the electrode 3. According to this type of discharge lamps, the electrode 3 itself can be readily formed so that it is advantageously employed for a discharge lamp having a long configuration.

Figure 5:
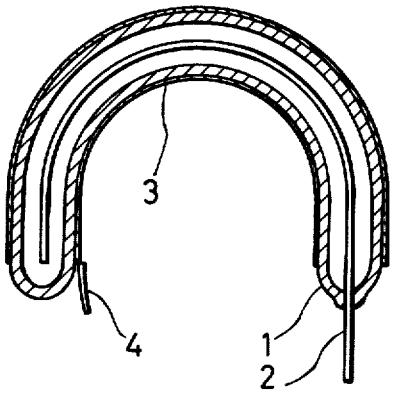

FIG. 5 shows a curved discharge lamp in which the electrodes 2 and 3 can be formed in the same manner as described in FIGS. 1–4.

Figure 6:
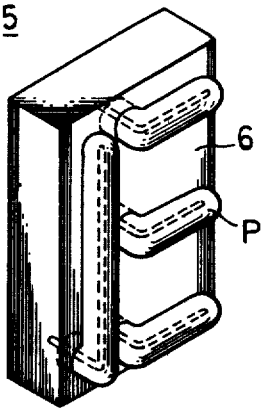
FIGS. 6 and 7 are perspective views of the display unit 5.

FIG. 6 shows a display unit 5 for displaying an alphabetical character "E" by positioning four straight discharge lamps P on the surface plate 6 thereof.

Figure 7:
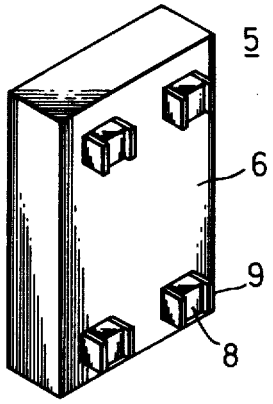

FIG. 7 shows a back portion of the display unit 5 illustrated in FIG. 6. There are shown magnets 8 as a connector means for connecting the display unit 5 to a display panel (see FIGS. 10 and 11) and electrically conductive segments 9 for repeating AC power to be supplied to the discharge lamp P.

Figure 8:
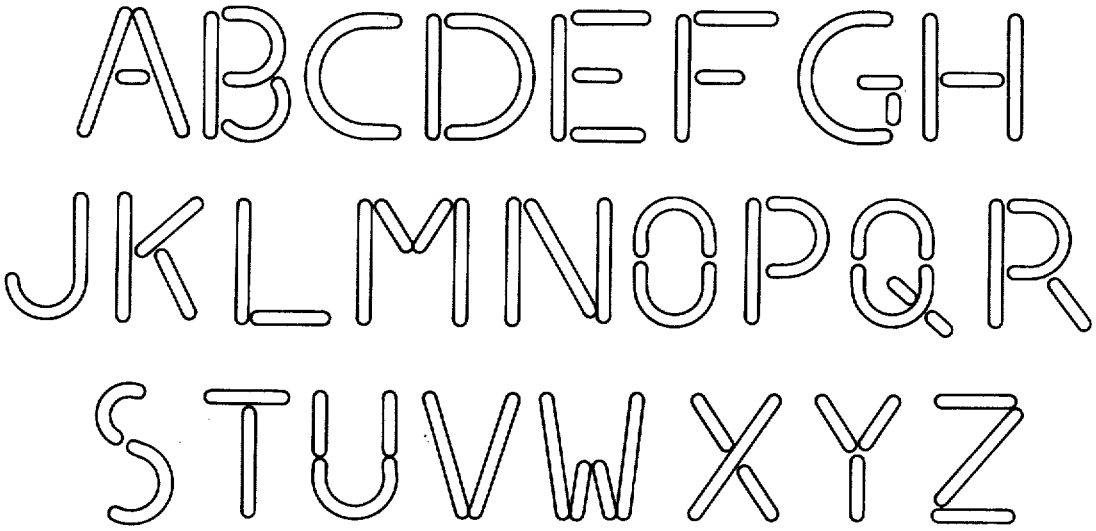
FIGS. 8(*a*), 8(*b*) and 8(*c*) are plan views of various characters, numerals and symbols to be displayed by the display unit.
Figure 8:
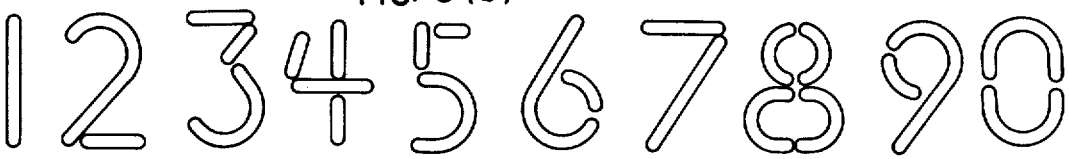
Figure 8:
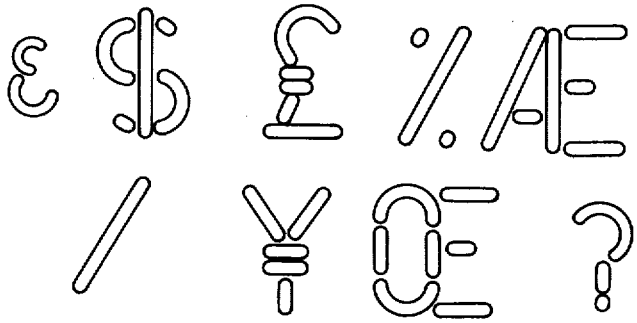

FIGS. 8(*a*), 8(*b*) and 8(*c*) respectively illustrate different types of displaying patterns which are formed to display various kinds of alphabetical characters, numerals, and symbols by suitably combining and positioning fifteen differently-shaped discharge lamps P1–P15 as shown in FIG. 8(*d*). Referring to FIG. 8(*d*), there are shown eight straight discharge lamps P1–P8 which are different in length, a raindrop-like discharge lamp P9, and six curved discharge lamps P10–P15 which are different in radius of curvature and length of straight portion thereof. The preferred sizes of the discharge lamps P1–P15 as shown in FIG. 8(*d*) are listed below. By changing the diameter, length and radius of curvature of the discharge lamp appropriately in proportional relation to these sizes, various patterns of different sizes as desired may be displayed.

| DISCHARGE LAMP | L1 | L2 | L3 | L4 | L5 | R |
|---|---|---|---|---|---|---|
| P1 | 6 | — | — | — | — | — |
| P2 | 10 | — | — | — | — | — |
| P3 | 15 | — | — | — | — | — |
| P4 | 20 | — | — | — | — | — |
| P5 | 25 | — | — | — | — | — |
| P6 | 35 | — | — | — | — | — |
| P7 | 40 | — | — | — | — | — |
| P8 | 43 | — | — | — | — | — |
| P9 | — | 4 | 10 | — | — | — |
| P10 | — | — | — | 1-2 | 1-2 | 10 |
| P11 | — | — | — | 4 | 4 | 10 |
| P12 | — | — | — | 1-2 | 1-2 | 12.5 |
| P13 | — | — | — | 7 | 7 | 12.5 |
| P14 | — | — | — | 1-2 | 27.5 | 12.5 |
| P15 | — | — | — | 7 | 7 | 20 |

(mm: glass tube diameter is 4 mm)

Figure 9:
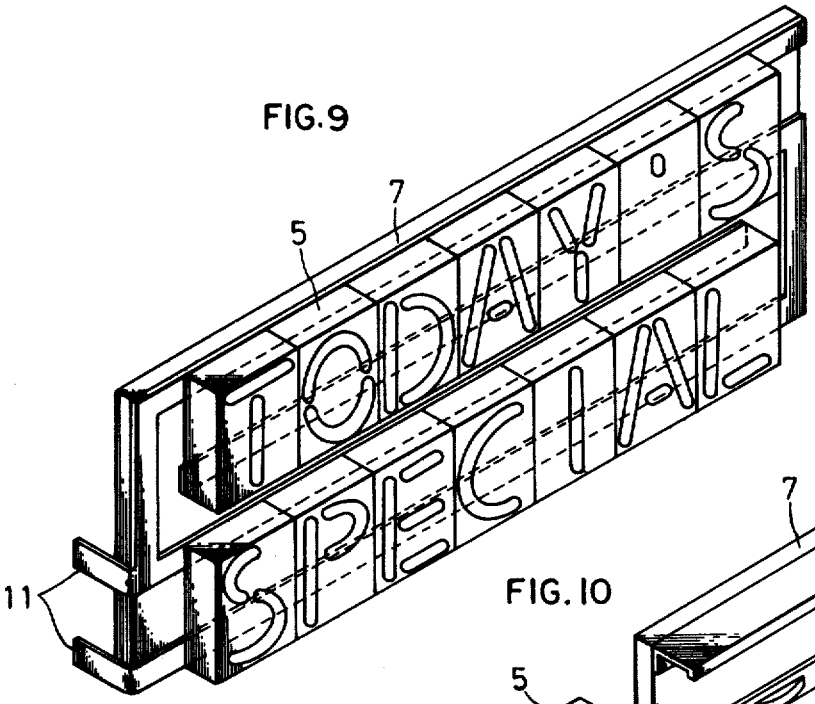
FIGS. 9 and 10 are perspective views of the display device utilizing a discharge lamp.

FIG. 9 shows a display panel 7 on which the display unit 5 is mounted. There is provided on the surface of the display panel 7 a pair of feeder plates 11 for supplying voltage from a AC power supply 10 (see FIG. 11) to the discharge lamp P on the display unit 5. The AC power supply 10 generates AC power, the voltage of which is several ten volts, for example, about 20–40 V and the frequency of which is several kilo hertz, for example, about 3–30 KHz. Since the magnets 8 as a connector means and the electrically conductive segments 9 as a repeater means to a power supply are arranged at substantially the same position, this permits power supplying from the display panel 7 to the display unit 5 and also connection of the display unit 5 to the display panel 7 without requiring a specific magnetizing means by utilizing an electrically conductive and magnetizable material such as a galvanized sheet or tin plate for a feeder plate 11.

As can be appreciated from FIG. 9, various kinds of characters and symbols which can be displayed are combined and fourteen display units 5 are arranged to display a message of "TODAY'S SPECIAL".

Figure 10:
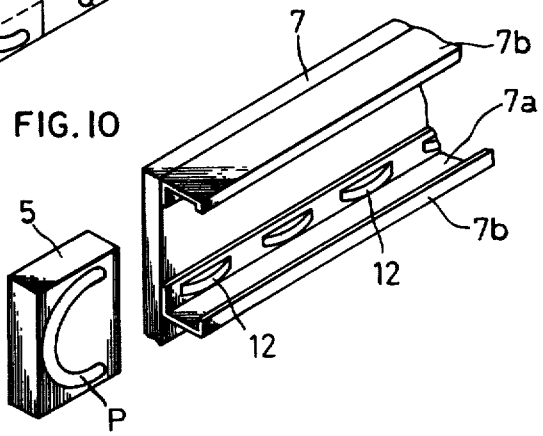

FIG. 10 shows an alternative embodiment of the display device using a discharge lamp in which a pair of rails 7b having a groove 7a as a connecting means are mounted on the display panel 7 for connecting the display unit 5 to the display panel 7. According to the present embodiment, the display unit 5 is succesively received into the groove 7a defined by the rails 7b mounted on the display panel 7 to display information in the same manner as in FIG. 9. As shown in FIG. 10, a feeder plate 12 is provided on the side wall of the rail 7b on the display panel 7 to be brought into contact with the electrically conductive segment 9 attached on the rear surface of the display unit 5, and the feeder plate 12 is preferably made of electrically conductive and resilient material, so that it serves as a power supply means and a connecting means.

Figure 11:
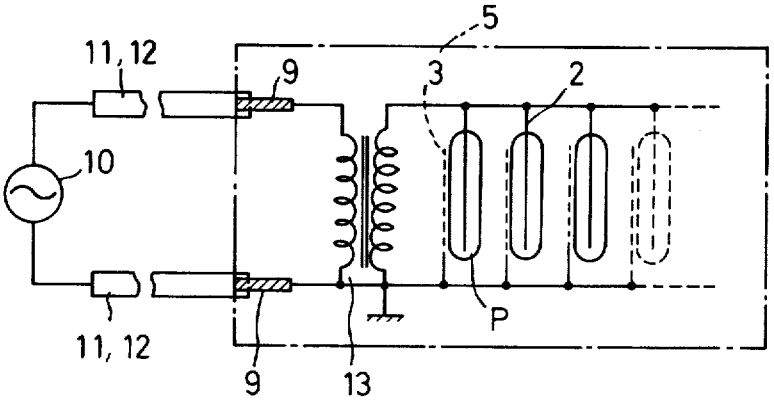
FIG. 11 is a schematic diagram of the circuit enclosed in the display device.

FIG. 11 shows a schematic diagram of the circuit enclosed in the display device using a discharge lamp as hereinbefore described. In the display unit 5, a boosting transformer 13 is accommodated by raising AC voltage supplied from the AC power supply 10 through the feeder plates 11, 12 and the electrically conductive segments 9 to the extent that the voltage may be maintained to permit electro-luminescence by the discharge lamp P. When the above described discharge lamp P is being used, the AC voltage may be preferably raised to the extent of 200–2000 V by the boosting transformer 13.

Figure 12:
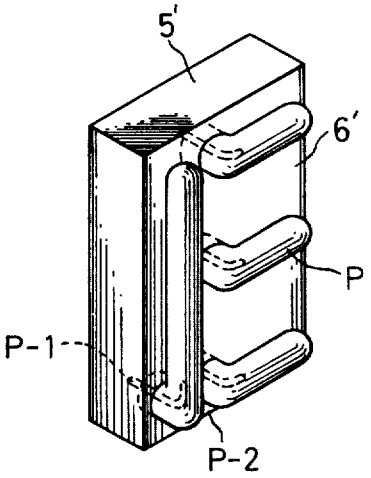
FIGS. 12 and 13 are perspective views of the display unit 5' applied to the display device according to the present invention.

FIG. 12 shows an alternative embodiment of the display unit 5' for displaying an alphabetical character "E" by positioning four straight discharge lamps P on the surface plate thereof. The discharge lamp P may be formed as discussed in the preceding paragraphs, namely, one relatively longer or shorter electrode P-1 is provided in the glass tube and the other transparent electrode P-2 is provided around the outer surface of the glass tube. This type of discharge lamp P can be flashed with substantially uniform luminance at a lower voltage and a lower frequency than the discharge lamp such as neon lamp normally having two electrodes disposed at both opposed ends of the glass tube.

Figure 13:
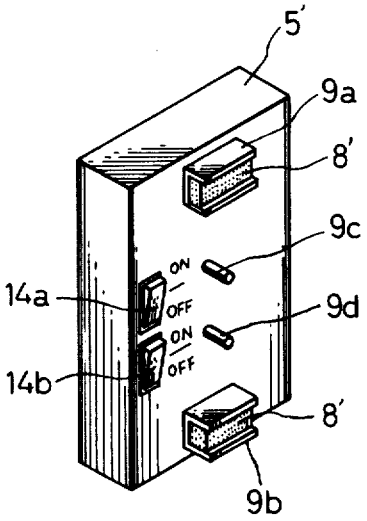

FIG. 13 shows a back portion of the display unit 5' illustrated in FIG. 12. The display unit 5' is provided on its back portion with a connector means 8' such as magnets for connecting the display unit 5' to the display panel 7' as will be hereinafter described (see FIG. 15), electrically conductive segments 9a, 9b, 9c, and 9d and switches 14a, 14b. When the display unit 5' is disposed on the display panel 7', these electrically conductive segments 9a, 9b, 9c, and 9d serve to repeat the DC voltage supplied from a power supply means (as will be hereinafter described) and the control signals supplied from a control signal generating means. The power supply means and the control signal generating means are included in the means for flashing the discharge lamp P. Switches 14a, 14b serves to on-off control the control signals applied through the electrically conductive segments 9c, 9d to the display unit 5'.

Figure 14:
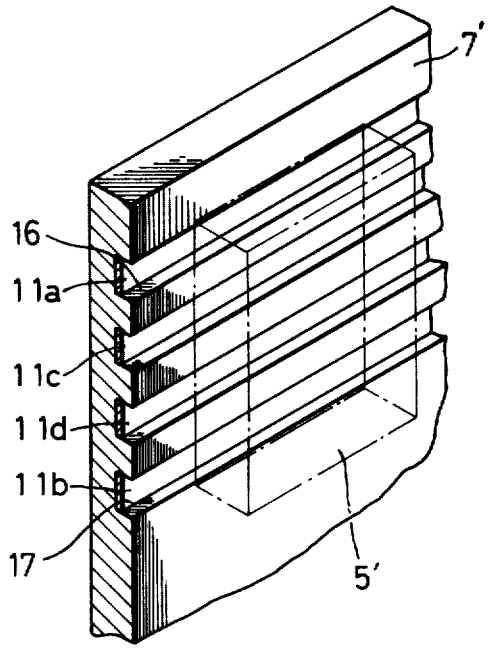
FIGS. 14 and 15 are a perspective and a plan view of the display panel 7', respectively.
Figure 15:
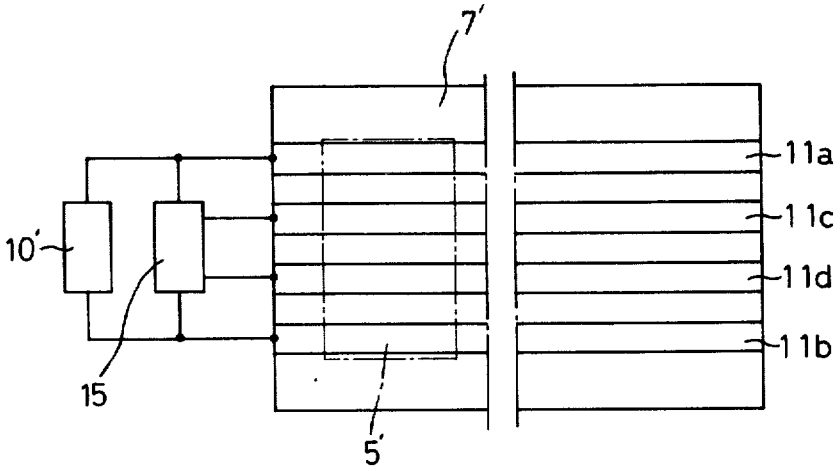

FIGS. 14 and 15 show a display panel 7' on which are provided feeder plates 11a, 11b, 11c, 11d directly attached to the electrically conductive segments 9a, 9b, 9c, 9d of the display unit 5' for supplying the DC voltage from the power supply 10' and the control signal from the control signal generator 15. The power supply 10' serves to supply a low DC voltage, for example, about 3–12 VDC through the pair of feeder plates 11a, 11b to the electrically conductive segments 9a, 9b of the display unit 5', and the control signal generator 15 serve to supply a control signal having a low frequency of 3–20 KHz, for example, through the pair of feeder plates 11c, 11b or 11d, 11b and in turn through the electrically conductive segments 9c, 9d or 9d, 9b, respectively.

Figure 16:
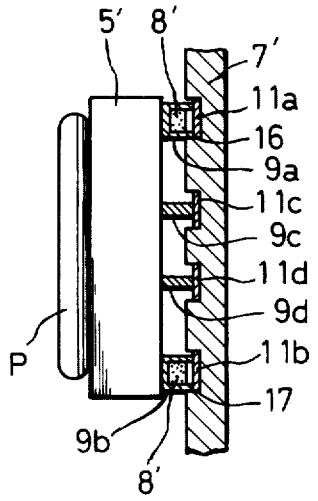
FIG. 16 is a partially sectional view of the display unit 5' engaged with the display panel 7'.
Figure 17:
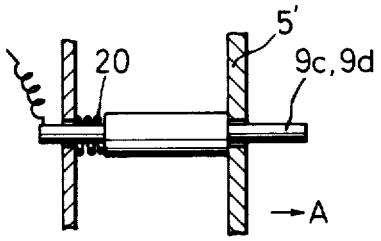
FIG. 17 is a partially sectional view of the electrically conductive segments 8' and 9' mounted on the display unit 5' in FIGS. 12 and 13.

FIG. 16 shows a display panel 7' combined to the display unit 5'. The electrically conductive segments 9a, 9b and the feeder plates 11a, 11b, 11c, 11d are made of electrically conductive and magnetizable material such as a galvanized sheet or tin plate. Thus, the display unit 5' may be connected to the display panel 7' by a magnetizing effect of the magnets 8' as a connecting means integrally combined with the electrically conductive plates 9a, 9b. In this arrangement, for purposes of preventing the display unit 5' from rotating or dropping by external force such as vibration or impact, the feeder plates 11a, 11b connecting to the electrically conductive segments 9a, 9b are preferably received in the grooves 16, 17 which are slightly wider than the height of the electrically conductive segments 9a, 9b. As shown in FIG. 17, the electrically conductive segments 9c, 9d contacting with the feeder plates 11c, 11d are preferably biased in the direction dipicted by the arrow A by the resilient force of a spring 20 so as not to inhibit the adsorption state of the feeder plates 11a, 11b and the electrically conductive segments 9a, 9b through the magnets 8'.

Figure 18:
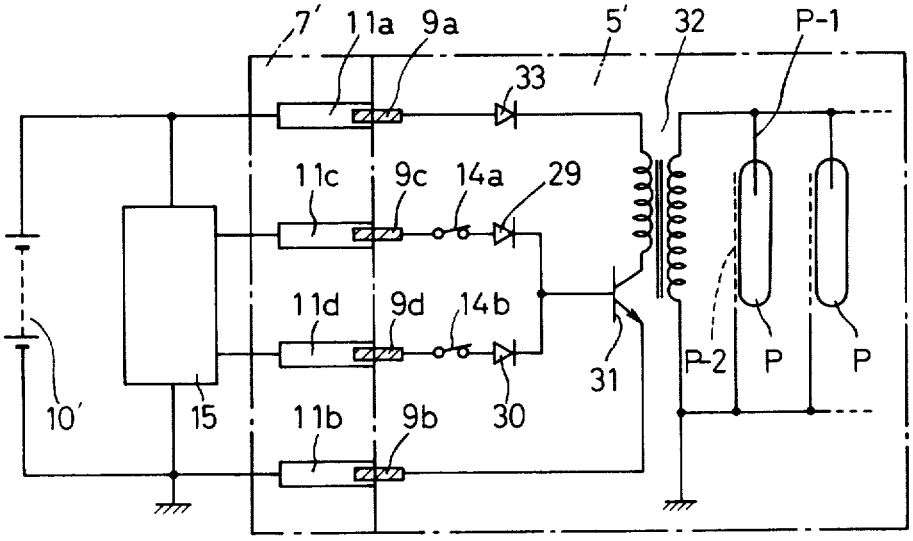
FIGS. 18 and 19 are schematic diagrams of the circuits enclosed in the display device.
Figure 19:
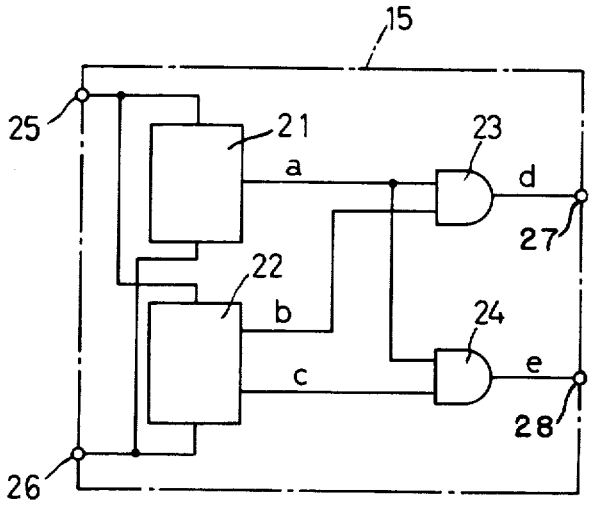
Figure 20:
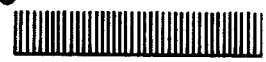
FIGS. 20(*a*) to (*e*) show wave forms of the output signals of the diagram in FIG. 19.
Figure 20:
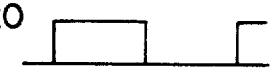
Figure 20:
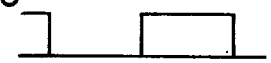
Figure 20:
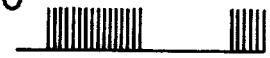
Figure 20:
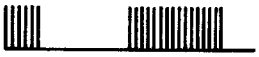
Figure 21A:
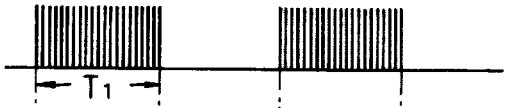
FIGS. 21(*a*) to (*e*) show a state of intermittent flashing control or continuous lighting control in response to the control signals.
Figure 21B:
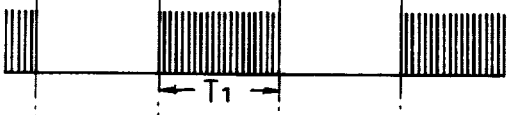
Figure 21C:
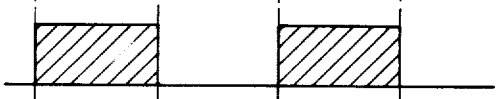
Figure 21D:
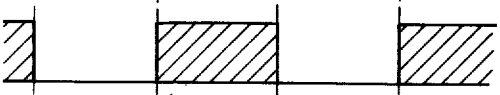
Figure 21E:
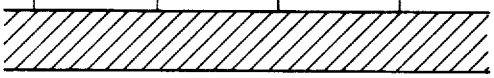

FIG. 18 shows a schematic diagram of the circuit enclosed in the display device according to the present embodiment. The control signal generator 15 serves to generate a control signal to be supplied through the feeder plates 11c, 11d of the display panel 7' to the display unit 5'. As shown in FIGS. 19 and 20, the control signal generator 15 is comprised of a first pulse signal generator 21 for generating pulse signals having several kilo hertz (see FIG. 20(*a*)), a second pulse signal generator 22 for generating pulse signals which are 180° out-of-phase and less than several hertz (see FIG. 20(*b*) and 20(*c*)), and AND Gate circuits 23, 24 for inputting both pulse signals from the pulse signal generators 21, 22 and generating pulse signals alternately and intermittently at every given period of time (see FIG. 20(*d*) and 20(*e*)). FIG. 19, input terminals 25, 26 are power input terminals connected to the power supply 10' in FIG. 18, and output terminals 27, 28 are control signal output terminals connected to the feeder plates 11c, 11d of the display panel 7' in FIG. 18.

Control signals from the control signal generator 15 are supplied through the electrically conductive segments 9c, and 9d mounted on the display unit 5', selectively operable switches 14a, 14b (see FIG. 13) and diodes 29, 30 to transistor 31. A boosting transformer 32 serves to raise the voltage of control signals supplied through the transistor 31 to the extent that the voltage may be maintained to permit electro-luminescence by the discharge lamp P. A pulse signal which is in the peak voltage range of about 200–2000 V and in the frequency range of about 3–20 KHz is applied to both electrodes P-1, P-2 of the discharge lamp P.

Diode 33 enclosed in the circuit of FIG. 18 serves as a reverse flow preventing diode for preventing failure of a circuit element such as transistor 31 if the electrically conductive segments 9a, 9b of the display unit 5' are connected to the feeder plates 11a, 11b on the display panel 7', respectively.

FIG. 21(*a*) shows a wave form of control output signal applied through electrically conductive segment 9c, switch 14a and diode 29 to transistor 31 of the display unit 5' in FIG. 18, and FIG. 21(*b*) shows a wave form of control output signal applied through electrically conductive segment 9d, switch 14d, and diode 30 to transistor 31 of the display unit 5' in FIG. 18. FIG. 12(*c*) shows a state in which the discharge lamp P is activated at every period of $T_1$ in response to the control signal as shown in FIG. 21(*a*) when only the switch 14a is on. FIG. 21(*d*) shows a state in which the discharge lamp P is activated at every period of $T_1$ in response to the control signal as shown in FIG. 21(*b*) when only the switch 14b is on. FIG. 21(*e*) shows a state in which the discharge lamp P continues to be activated in response to the control signal as shown in FIGS. 21(*a*) and 21(*b*) when both switches 14(*a*), 14(*b*) are on. In FIG. 21(*c*), 21(*d*) and 21(*e*), the activated state of the discharge lamp P is illustrated by the shadowed portion.

FIG. 22 shows in detail the wave form of output signal of control pulse signal (see FIG. 20(*a*)) generated by the first pulse signal generator 21 as shown in FIG. 19. FIG. 22(*b*) shows a wave form of output signal of pulse signal in the case that a pulse width t is halved so as to decrease the luminance of the discharge lamp P to save energy. FIG. 22(*c*) shows a wave form of output signal of pulse signal in the case that a pulse width t is doubled so as to increase the luminance of the discharge lamp P.

FIG. 23 shows in detail wave forms (see FIGS. 20(*d*), 20(*e*) and FIGS. 21(*a*) 21(*b*)) of output signals generated by the control signal generator 15 as shown in FIG. 19. FIGS. 23(*c*) and 23(*b*) in the case that the period $T_1$ intermittently controlled by the second pulse signal generator 22 (see FIG. 19) is halved, namely $T_{\frac{1}{2}}$ so as to decrease the on-off period of the discharge lamp P.

FIG. 24 illustrates an alternative embodiment of the display unit 5' as shown in FIG. 13, which is similar to the display unit 5' as shown in FIG. 13 except that the electrically conductive segments 9c', 9d' corresponding to the conductive segments 9c, 9d, respectively may be retracted from the display unit 5'' as is shown in FIGS. 25(*a*) and 25(*b*). Referring to FIGS. 24 and 25(*a*), when the electrically conductive segments 9c', 9d' are urged in the reverse direction of an arrow A against a resilient force of a spring 20 and in turn operably rotated, pins 34 on the electrically conductive segments 9c', 9d' are brought into engagement with a hook plate 35 as shown in FIG. 25(*b*). In FIG. 25(*b*), the electrically conductive segments 9c', 9d' are retracted by the distance L in contrast with the state in FIG. 25(*a*). As a result, even if the display unit 5'' is attempted to be mounted on the display panel 7', the electrically conductive segments 9c', 9d' are not electrically connected to the feeder plates 11c, 11d, thereby making it impossible for control signals to be supplied to the display unit 5''. According to the embodiment of FIGS. 24 and 25, the electrically conductive segments 9c', 9d' serve as a switch, and thus it is not necessry to provide switches 14a, 14b which are required in the prior embodiment of FIG. 13.

In the preferred embodiment of FIGS. 1–5, the distance between the electrodes 2 and 3 is substantially constant and relatively short which is not dependent upon the length of the glass tube 1 and it is not necessary to provide a starting circuit, but substantially the entire area of the glass tube 1 can be flashed with a uniform luminance by supplying to both electrodes 2 and 3 an AC power having a voltage of about 200–2000 V and a frequency of about 3 KHz and more, for example. In the case that the glass tube is charged by neon gas, the discharge lamp may be flashed into orange color, while in the case that the glass tube is charged by krypton or xenon gas, the discharge lamp may be flashed into blue color. If fluorescent material is applied by the inner wall of the discharge lamp, the discharge lamp may be flashed into a desired color, for example, if cadmium borate is utilized for the fluorescent material, the discharge lamp is flashed into red color, and if zinc silicate and calcium tungstate are utilized, the discharge lamp is flashed into green and blue color, respectively.

When the electrode 3 is formed on the outer longitudinal surface of the glass tube 1 at a suitable interval and width, only the suitable portion of the length of the glass tube 1 can be flashed.

The electrode 3 may be a plurality of spiral electrodes, and the fluorescent material to be applied to the inner surface of the glass tube 1 may be varied according to each spiral electrode 3 by switching current flow through each spiral electrode 3. As a result, various colors of electro-luminescence in accordance with the spiral electrode of the glass tube are suitably obtained.

According to the present invention, firing voltage and discharging voltage may be lowered, and thus it is not necessary to provide a starting circuit, and a discharge lamp can be simple in construction and small in size to be safely flashed. Further, since power consumption at discharging may be minimized, the discharge lamp according to the present invention may be widely employed for an energy-saving type of pilot lamps or beacon lamps.

Electrodes 2 and 3 may be formed of a flexible material so as not to affect electro-luminescence even if a portion of the electrodes are brought into contact with a glass tube 1.

In one experiment, 1 mmA of discharging current allows a discharge lamp to be flashed more than hundred thousand hours.

According to the present invention, the setting of frequency to about 10 KHz permits discharging operation to be more stabilized and the setting of frequency to the range of about 15 KHz to 20 KHz avoids adverse influence to audio instruments.

To display desired information, a display unit 5 is first selected for displaying a required character, numeral, or symbol. Thereafter, as shown in FIGS. 9 and 10, the selected display unit 5 is succesively arranged on the display panel 7. At this moment, AC power is supplied from the AC power supply 10 to the feeder plates 11 and 12 and in turn, is supplied through the electrically conductive plate 9 of each display unit 5 to the boosting transformer 13. As a result, AC voltage required for discharge with electro-luminescence is applied to both electrodes 2 and 3 of the discharge lamp P and the desired information displaying can be carried out by the electro-luminescence of the discharge lamp P. Since the display unit 5 of the present embodiment is simply attachable to or detachable from the display panel 7, it is extremely advantageous whenever any alteration in displayed information is necessary.

In the present embodiment, there is described a feeder plates 11, 12 to which low AC voltage is supplied, however if DC-AC converter including a oscillator for generating signals in the frequency range of about 3–30 KHz is enclosed in the display unit 5 in addition to the boosting transformer 13, the discharge lamp is capable of being flashed by supplying DC voltage enough to drive the oscillator, for example, about 3–10 VDC to the feeder plates 11, 12.

In this case, because only low DC voltage is required, the display device is available for vehicles, and since a small battery as a DC power source may be enclosed in the display unit 5, the display device may be widely used for a portable displaying means. If the discharge lamps P arranged in accordance with various characters or numeral patterns are formed with or embedded in the surface plate 6 by transparent acrylic resin, the discharge unit 5 may become more safe and convenient to use.

In the preferred embodiment of FIGS. 12–27, to display desired information, a display unit 5' is first selected for displaying a required character, numeral or symbol. Thereafter, the selected display unit 5' is succesively arranged on the display panel 7' as shown in FIGS. 14 and 15. At this moment, the electrically conductive segments 9a, 9b are brought into engageent with the feeder plates 11a, 11b on the display panel 7' through the adsorption force by a magnetizing effect of the magnets 8' integrally formed with the electrically conductive segments 9a, 9b. As a result, the display unit 5' is adapted to be disposed on the display panel 7'. At the same time, the electrically conductive segments 9a, 9b, 9c, 9d on the display unit 5' are brought to contact with the feeder plates 11a, 11b, 11c, 11d on the display panel 7', respectively as shown in FIG. 16. When both of the switches 14a, 14b in FIGS. 13 and 18 are on, DC voltage from the power supply 10' is supplied through the feeder plates 11a, 11b and the electrically conductive segments 9a, 9b which are in contact with feeder plate 11a, 11b to transistor 31 of the display unit 5', while the control signal (see FIGS. 20(*a*), 20(*e*) and FIGS. 21(*a*), 21(*b*)) from the control signal generator 15 are alternately supplied at every given period of time $T_1$ through the feeder plates 11c, 11d, the electrically conductive segments 9c, 9d which are in contact with the feeder plates 11c, 11d, the switches 14a, 14b and diodes 29, 30 in the display unit 5' to the base of transistor 31. Namely, the control signal is succesively supplied to the primary winding of the boosting transformer 32 in FIG. 18, and power having voltage and frequency required for discharge is supplied between the electrodes P-1 and P-2 of the discharge lamp P, thereby permitting the discharge lamp P to successively flash as illustrated in FIG. 21(*e*) and to display suitable information.

When one of the switches 14a, 14b mounted on the display unit 5' in FIG. 13 is on and the other is off, either of the control signals as shown in FIGS. 21(*a*) and 21(*b*) is applied to the base of transistor 31 at every given period of time $T_1$, thereby permitting the discharge lamp P to flash intermittently as shown in FIG. 21(*c*) or FIG. 21(*d*) and to display information which can be distinguished from other information succesively displayed. Since phase of the control signal applied to the boosting transformer 32 in the case that the switch 14a is on and the switch 14b, is off is reversed when the switch 14a is on and the switch 14b is off, the discharge lamp P alternately flashes with electroluminescence at every given period of time $T_1$. Accordingly, the selective operation of the switches 14a, 14b causes the flash timing of display to be varied. When both of the switches 14a, 14b are off, no control signals are supplied to the display unit 5', and as a result, the discharge lamp P is maintained at off and displays no information.

As shown in FIGS. 22(*b*) and 22(*c*), the pulse width (the duty ratio) of the pulse signal generated from the first pulse signal generator 21 of the control signal generator 15 may be suitably changed so as to control the luminance of the display lamp P upon flashing.

Similarly, as shown in FIGS. 23(*c*), 23(*d*), 23(*e*), 23(*f*), the pulse width of the pulse signal generated from the second pulse generator 22 of the control signal generator 15 may be suitably changed so as to control the flashing period of the discharge lamp P.

It should be apparent that in the display unit 5'' of FIGS. 24 and 25 where the conductive segments 9c', 9d' are retractably mounted on the display unit 5'' in such a manner that the conductive segments 9c', 9d' are urged into the display unit 5'' and in turn, rotated, the conductive segments 9c', 9d' is selectively operated so as to obtain the aforementioned effect.

In the present embodiments, the control signal is rectangular pulse, but it should be apparent that any forms of control signals such as triangular pulse, saw tooth pulse, or sine wave signal may be used.

Furthermore, the present embodiments show the system to control the flashing at every given period of time or the alternate flashing by two couples of feeder plates and conductive segments, but increase in the number of feeder plate and conductive segment enables the manner of control of electro-luminescence to become more variable.

Figure 26:
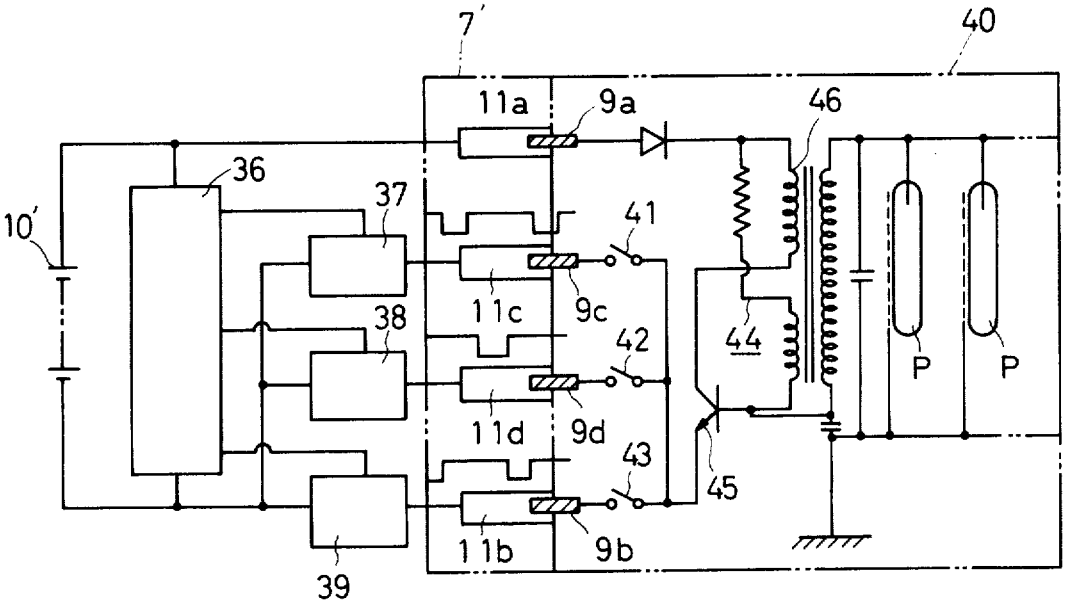
FIGS. 26 and 27 show schematic diagrams of the circuits enclosed in the display device of an alternative embodiment according to the present invention.

FIG. 26 is an electrical circuit of an alternate embodiment according to the present invention, in which AC power with the phase being reversed each other as illustrated by the wave forms over the feeder plates 11c, 11d, 11b in FIG. 26 is supplied from the power supply 10' to the feeder plates 11a, 11c, 11d, 11b by the on-off control of a switching elements 37, 38, 39 through a ring counter 36. Then the AC power is supplied through the conductive segments 9a, 9c, 9d, 9b to the display units 40 arranged on the display panel 7', respectively and in turn, is selectively supplied by the switches 41, 42, 43 on the display units 40 to DC-AC inverter 44 which is a self-excited oscillator including transistor 45 and primary winding of the boosting transformer 46, while power having enough frequency (3–30 KHz) and enough voltage (200–2000 V) to continually maintain the electro-luminescence of the discharge lamp P is supplied from the boosting transformer 46. As a result, the discharge lamp P is capable of flashing, continually turning on or turning off at an appropriate phase angle according to the selection of the switches 41, 42, 43. This embodiment is similar to the aforementioned embodiments except that the number of the feeder plates 11a, 11c, 11d, 11b to which power having different phases is supplied is especially decreased.

Figure 27:
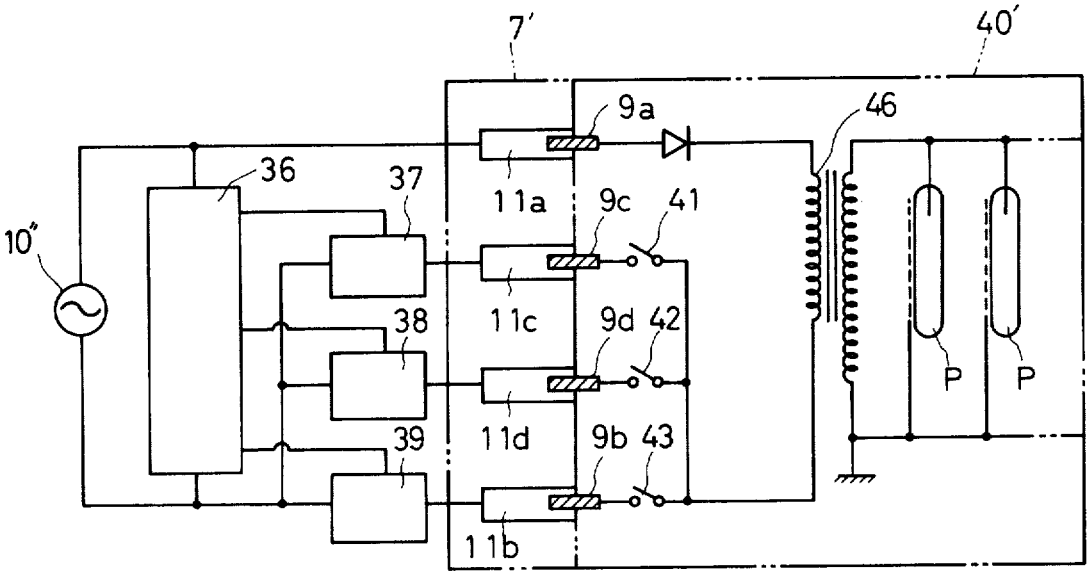

FIG. 27 also shows an electrical circuit of an alternate embodiment according to the present invention, in which AC power supply 10'' is substituted for the DC power supply 10' in FIG. 26 and DC-AC inverter 44 in FIG. 26 is obviated to form a display unit 40'.

If the voltage applied from the AC power supply 10'' is enough to continually maintain the electro-luminescence of the discharge lamp P, the boosting transformer 46 may be obviated from the display units 40'.

It is further understood by those skilled in the art that the foregoing description is a preferred embodiment of the disclosed device and that various changes and modifications may be made in the invention without departing from the spirit and scope thereof.

What is claimed is:

1. Disply device using a discharge lamp comprising:

a discharge lamp formed by a glass tube in which inert gas is charged, comprising a pair of electrodes one of which is provided within said glass tube and the other is formed of transparent electrically conductive film deposited on the exterior surface of and extending over the length of said glass tube whereby said discharge lamp is energized for illumination by a source of pulse or AC voltage of a frequency not greater than about 30 kHz being applied between said two electrodes.

2. The discharge lamp as defined in claim 1 including a fluroescent film coated on the inner surface of said glass tube.

3. Display device using a discharge lamp comprising:

a discharge lamp formed by a glass tube in which inert gas is charged, said discharge lamp having a pair of electrodes one of which is provided within said glass tube and the other is provided outside of said glass tube;

a display unit for displaying characters, numerals or symbols comprising a surface plate including a back portion having at least two electrically conductvie segments, a boosting transformer mounted within said display unit for boosting pulse signals or AC signals, and one or more discharge lamps arranged on said surface plate;

a display panel for displaying at least a display unit;

said display panel comprising at least two electrically conductive and magnetizable feeder plates adapted to be connected to an external power supply for connecting said boosting transformer to the external power supply, said feeder plates being arranged in each position corresponding to said electrically conductive segments mounted on the back portion of said display unit, said feeder plates being electrically connected to said electrically conductive segments when at least a display unit is engaged with said display panel; and means for magnetically engaging said display unit with said display panel with the conductive segments contacting the feeder plates;

whereby pulse signals or AC signals from a pulse signal or AC signal generating means being supplied through said feeder plates, electrically conductive segments and boosting transformer in said display unit to both electrodes of said discharge lamp cause said discharge lamp to be discharged.

4. Display device using a discharge lamp as defined in claim 3 further including:

a pulse signal or AC signal generating means for supplying pulse signals or AC signals to said pair of electrodes of said discharge lamp for discharging said lamp;

said boosting transformer being supplied through transistor means;

means for supplying electrical power to said transistor in said display unit; and said display panel being constructed for displaying a plurality of said display units to present a message indicated by the combination of characters, numerals or symbols represented by said display units and including at least three feeder plates arranged in each position corresponding to said electrically conductive segments mounted on the back portion of said display unit.

5. Display device using a discharge lamp as defined in claim 4 further including:

a pulse signal or AC signal generating means for supplying pulse signals or AC signals to both electrodes of said discharge lamp for discharging said lamp;

control means for supplying pulse signals or AC signals alternately at every give period of time, said means being connected to said pulse signal or AC signal generating means; and said display panel being constructed for displaying at least two different messages at every given period of time.

6. Display device using a discharge lamp as defined in claim 4 further including means for on-off controlling the firing of said discharge lamp by intermittently supplying pulse signals or AC signals through said feeder plates and electrically conductive segments to said transistor.

7. Display device using a discharge lamp as defined in claim 4 further including a switching means for continuously firing said discharge lamp or on-off controlling the firing of said discharge lamp by continuously or intermittently supplying pulse signals or AC signals through said control means to said transistor, said switching means being arranged between said control means and transistor.

8. Display device as defined in claim 3 wherein:

said boosting transformer is supplied through transistor means;

means for supplying electrical power to said transistor in said display unit;

said display unit comprising at least three electrically conductive segments;

said display panel comprising at least three feeder plates arranged in each position corresponding to said electrically conductive segments mounted on the back portion of said display unit; and said display panel comprising means for displaying a message comprised by a plurality of display units comprising characters, numerals or symbols.

9. Display device as defined in claim 8 wherein said display units comprising said plurality of display units are different in shape and length.

* * * * *